United States Patent [19]

Aoki et al.

[11] 3,952,537

[45] Apr. 27, 1976

[54] REVERSING VALVE MEANS FOR USE WITH A REVERSIBLE REFRIGERATING CYCLE SYSTEM

[75] Inventors: Tadashi Aoki, Iruma; Yasuo Komiya, Tokyo, both of Japan

[73] Assignee: Kabushiki Kaisha Saginomiya Seisakusho, Tokyo, Japan

[22] Filed: Oct. 2, 1974

[21] Appl. No.: 511,273

[52] U.S. Cl. ..... 62/324

[51] Int. Cl.[2] ..... F25B 29/00

[58] Field of Search ..... 62/324, 160

[56] References Cited

UNITED STATES PATENTS

| | | | |
|---|---|---|---|
| 2,974,682 | 3/1961 | Trask | 62/160 |
| 2,976,701 | 3/1961 | Greenawalt | 62/324 |
| 2,983,286 | 5/1961 | Greenawalt | 62/324 |
| 2,991,631 | 7/1961 | Ray | 62/324 |
| 3,032,312 | 5/1962 | Greenawalt | 62/160 |
| 3,056,574 | 10/1962 | Greenawalt | 62/324 |
| 3,303,665 | 2/1967 | Ray | 62/324 |
| 3,400,736 | 9/1968 | Bastle | 62/324 |

*Primary Examiner*—William E. Wayner

*Attorney, Agent, or Firm*—Woodhams, Blanchard and Flynn

[57] ABSTRACT

A reversing valve means for use with a reversible refrigerating cycle system in which a selector valve is actuated by pressure difference in the refrigerant gas and not by any mechanical means such as spring or the like. Said valve means is simple in construction and excellent in durability, enabling sure switchover of a heating cycle to a cooling cycle and vice versa.

7 Claims, 4 Drawing Figures

REVERSING VALVE MEANS FOR USE WITH A REVERSIBLE REFRIGERATING CYCLE SYSTEM

The present invention relates to a reversing valve means for use with a reversible refrigerating cycle system.

It has been proposed to provide several kinds of reversible refrigerating cycle system having a reversing valve which is actuated by some mechanical means such as spring or the like. However, such conventional apparatus using, for example a spring tends to easily get out of order because of inherent insufficient strength of the spring.

Therefore the present invention has been made to overcome such defects and make improvement in a reversible refrigerating cycle system.

It is an object of the present invention to provide a reversing valve means for use with a reversible refrigerating cycle system which enables a sure switchover of a cooling cycle to a heating cycle or in reverse by means of ON-OFF operation of a pilot electromagnetic valve means.

It is another object of the present invention to provide a reversing valve means for use with a reversible refrigerating cycle system in which in order to change a flow circuit of refrigerant, a selector valve is actuated by a pressure difference in the refrigerant derived from ON-OFF operation of a pilot electromagnetic valve means.

It is a further object of the present invention to provide a reversing valve means for use with a reversible refrigerating cycle system which is simple in construction and excellent in durability.

According to the present invention, there is provided a reversing valve means for use with a reversible refrigerating cycle system comprising first and second means functioning in reverse as a condenser and an evaporator; a compressor means associated with said first and second means; a cylinderical reversing valve body associated with said first and second means and with said compressor means, said reversing valve body having a first and a second ports communicating with pipes of said first and second means respectively, a third port located between said first and second ports and communicating with a suction pipe of the compressor and a fourth port communicating with a discharge pipe of the compressor, said first, second and third ports being provided at one side of said reversing valve body in the axial direction thereof in alignment with one another; a valve seat having three holes each corresponding to said first, second and third ports, respectively; a selector valve connected with a valve rod which has a larger pressure-sensing portion and a smaller pressure-sensing portion and moves within said reversing valve body in the axial direction thereof by means of pressure-difference, said selector valve having a concave thereunder adapted to connect said third port selectively with said second port and said first port and being made to slide on said valve seat; a switchover section associated with said reversing valve body and having a common passage, a first passage for introducing high-pressure refrigerant, a second passage for introducing low-pressure refrigerant; and a pilot electromagnetic valve means adapted to connect said common passage selectively with said first passage and said second passage.

The invention will be better understood from the following description taken in connection with the accompanying drawings in which.

Figure 1:
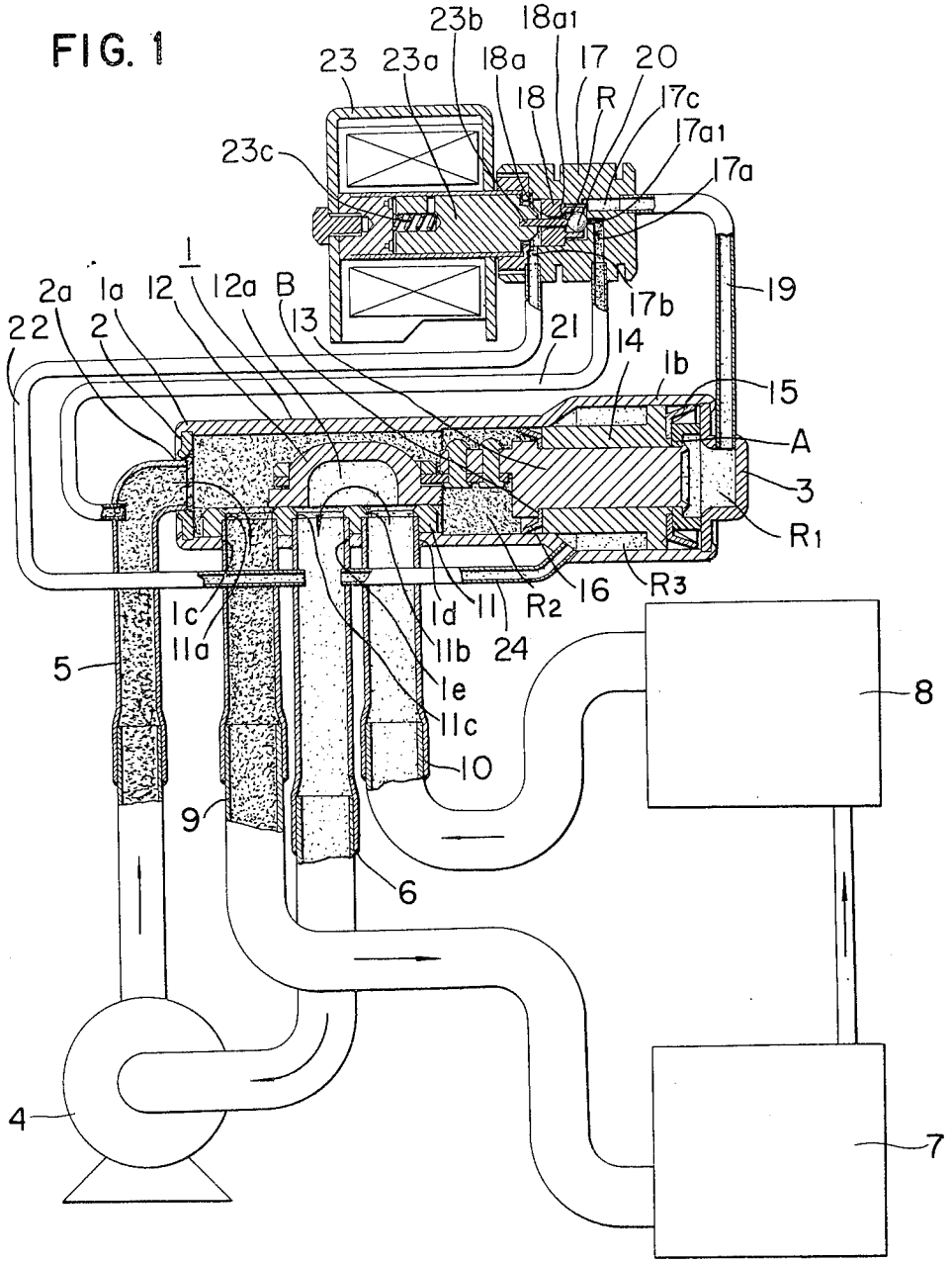
FIG. 1 is a vertical section of a reversing valve means for use with a reversible refrigerating cycle system of the present invention, illustrating its operation during a cooling cycle.

Referring now to FIGS. 1 to 4, there is illustrated one embodiment of the present invention. Numeral 1 designates a horizontally extending cylindrical reversing valve body, which has a relatively small diameter-portion 1*a* and a relatively large diameter-portion 1*b*. Said reversing valve body 1 is provided with end closure members 2 and 3 at its both ends respectively and is hermetically sealed by welding.

In said end closure member 2, there is formed a fourth port 2*a* of the reversing valve body 1, communicating with a discharge pipe 5 of a compressor 4. At one side of said reversing valve body 1 there are provided a first port 1*c*, a second port 1*d* and a third port 1*e*, said third port 1*e* being located between said first port 1*c* and said second port 1*d* and communicating with a suction pipe 6 of the compressor 4. Said first port 1*c* and said second port 1*d* respectively communicate with pipes 9 and 10 which are connected with a first means 7 and a second means 8, respectively. Said first means 7 and a second means 8 are adapted to operate in reverse respectively as a condenser and an evaporator and vice versa. Said suction pipe 6 and said two pipes 9 and 10 are fixed respectively to said third, first and second ports 1*e*, 1*c* and 1*d* in such a manner that they protrude into the reversible valve body 1. Thus, end portions of said pipes 6, 9 and 10 are adjacently disposed inside the reversing valve body in the axial direction of said body. Onto said end portions of the pipes 6, 9 and 10 there is fixedly mounted a valve seat 11 having holes 11*a*, 11*b* and 11*c* corresponding to said pipes 6, 9 and 10, respectively. A selector valve 12 is provided slidably on said valve seat 11 and has thereunder a concave 12*a* adapted to connect said pipe 6 selectively with said pipe 10 and said pipe 9. Said selector valve 12 is fixedly connected with a valve rod 13, said valve rod 13 being supported by a guide member 14 provided therearound, to provide a pistonlike unit adapted to move within the reversing valve body 1 in the axial direction thereof.

At one end of said valve rod 13 there is fitted an L-shaped packing means 15 slidably contacting with the portion 1*b* so as to form a larger pressure-sensing portion A and at another end of the valve rod 13 there is fitted an L-shaped packing means 16 slidably contacting with the portion 1*a* so as to form a smaller pressure-sensing portion B. Said larger pressure-sensing portion A cooperates with a wall of the reversing valve body to form a room $R_1$ and said smaller pressure-sensing portion B cooperates with a wall of the reversing valve body to form a room $R_2$.

Numeral 17 designates a switchover section. Said switchover section 17 has a first passage 17*a*, a second passage 17*b* and a common passage 17*c*. Inside said switchover section 17 there is screwedly provided a valve body 18 leaving a room R therebetween, said valve body 18 having a hole 18*a*. With said room R are communicated said first passage 17*a*, said second passage through said hole 18*a* and said common passage 17*c*. Said common passage 17*c* is further communicated with the room $R_1$ of the reversing valve body 1 through a pilot tube 19.

In the room R there is provided a ball 20 which is adapted to close selectively a port $17a_1$ of the first passage 17*a* and a port $18a_1$ of the hole 18*a* thereby to connect selectively said first passage 17*a* and said second passage 17*b* with said common passage 17*c*.

The first passage 17*a* is insertedly connected on one end of an extraction pipe 21 for introducing a high pressure refrigerant, said extraction pipe 21 being connected at the other end thereof with the discharge pipe 5. The second passage 17*b* is insertedly connected to one end of an extraction pipe 22 for introducing a low pressure refrigerant, said extraction pipe 22 being connected at the other end thereof with the suction pipe 6. With the switchover section 17 there is provided a pilot electromagnetic valve means 23 by any conventional means. A plunger 23*a* of said means 23 is provided with a rod 23*b* which reaches the room R through the hole 18*a* of the valve body 18. When the electromagnetic valve means 23 is not charged with electric current, the plunger 23*a* is pressed to the right in the drawing by the action of a coil spring 23*c* so that the rod 23*b* may press the ball 20 against the port $17a_1$; and when the electromagnetic valve means 23 is charged with electricity, the plunger 23*a* is pulled to the left and the ball 20 also moves to the left in the drawing to thereby close the port $18a_1$. Numeral 24 designates an extraction pipe provided for introducing and discharging a low pressure refrigerant into and from an annular space $R_3$ defined by the guide member 14 and a wall of the relatively large diameter-portion 1*b* of the reversing valve body 1 in order to permit the movement of the valve rod 13.

Now the operation of the above described valve means is explained.

In the embodiment shown in the drawings, the first means 7 acts as an outside heat exchanger and the second means 8 acts as an inside heat exchanger.

Referring to FIG. 1, the operation of the present valve means in its cooling cycle is explained.

An electromagnetic coil of the pilot electromagnetic valve means 23 is not electrically charged and the plunger 23*a* moves to the right in the drawing by the action of the coil spring 23*c*. The rod 23*b* presses the ball 20 so as to close the port $17a_1$. The port $18a_1$ communicates with the room $R_1$ of the reversing valve body 1 through the common passage 17*c* and the pilot tube 19. The valve rod 13 is now at the right hand of the valve body 1 as shown in the drawing.

In this instance the selector valve 12 also moves to the right thereby to connect the second port 1*d* with the third port 1*e* and the first port 1*c* with the fourth port 2*a*. The regrigerant flows in the direction shown by arrows in the drawing. The first means 7 acts as a condenser and the second means 8 acts as an evaporator.

In the drawing, the high-pressure refrigerant portion $P_1$ is densely dotted and the low-pressure refrigerant portion $P_2$ is sparsely dotted.

Figure 2:
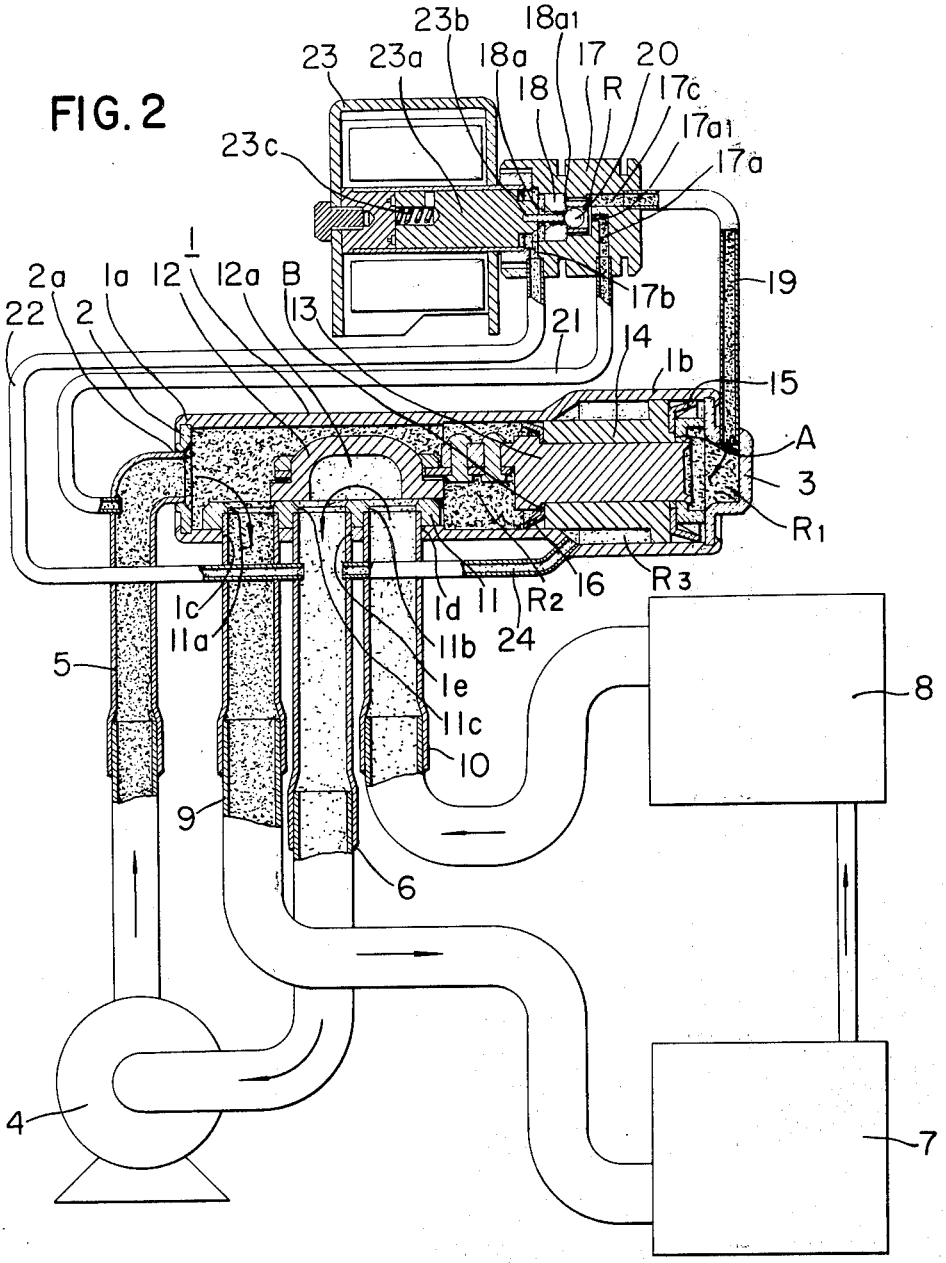
FIG. 2 is a view similar to FIG. 1, illustrating its operation just after a cooling cycle has been changed to a heating cycle.

Referring to FIG. 2, a switchover operation of the cooling cycle of FIG. 1 to a heating cycle is explained. The electromagnetic coil of the pilot electromagentic valve means 23 is electrically charged and the plunger 23*a* is attracted to the left by the electromagnetic force. By the force of high-pressure refrigerant introduced into the first passage 17*a* through the extraction pipe 21, the ball 20 moves to the left thereby to open the port $17a_1$ and to close the port $18a_1$. The high pressure gas thus introduced into the room R is introduced into the room $R_1$ through the pilot tube 19 and then acts upon the large pressure-sensing portion A of the valve rod 13.

In this instance both the rooms $R_1$ and $R_2$ are filled with high-pressure gas. The valve rod 13 is pushed towards the left in the drawing by pressure-difference caused by the relationship shown by the inequality $A \times P_1 > B \times P_1$.

Figure 3:
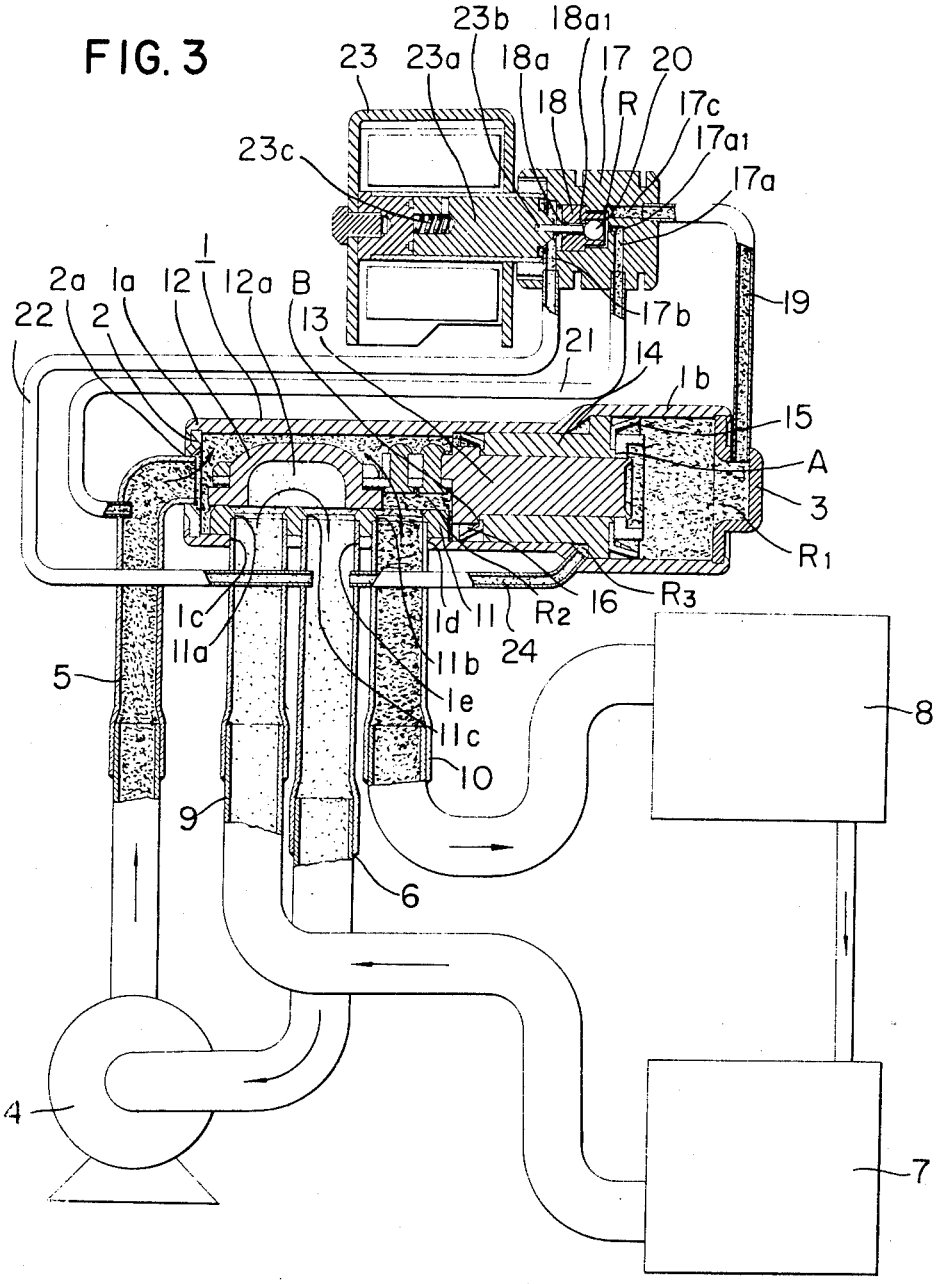
FIG. 3 is a view similar to FIG. 1, illustrating its operation during a heating cycle.

In FIG. 3, the valve rod 13 moves further to the left from the position shown in FIG. 2 and the cooling cycle is now completely converted into the heating cycle. The first port 1*c* communicates with the third port 1*e* and the second port 1*d* communicates with the fourth port 2*a*. The refrigerant flows in the direction shown by arrows in the drawing, and the first means 7 acts as an evaporator and the second means 8 acts as a condenser.

Figure 4:
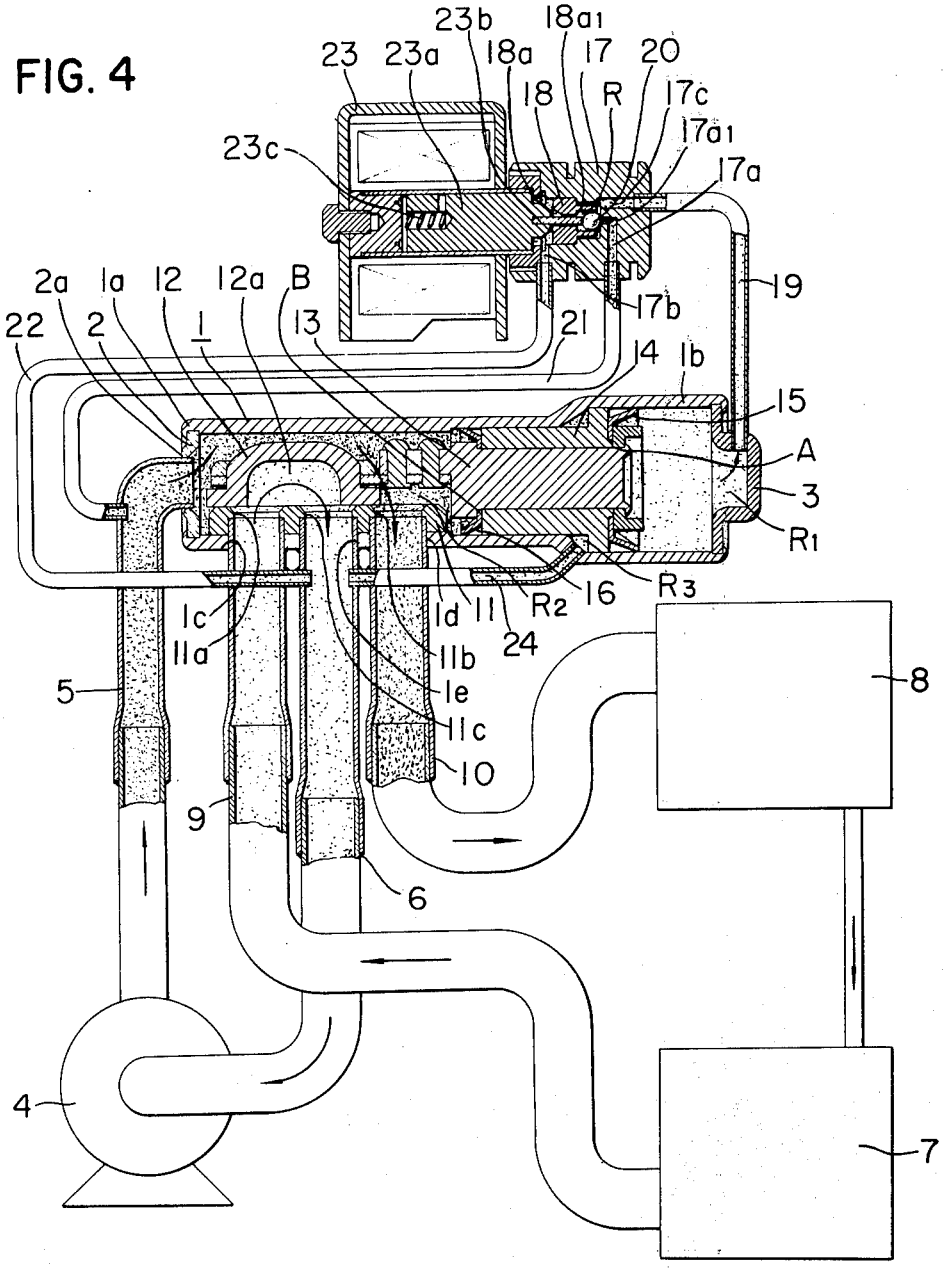
FIG. 4 is a view similar to FIG. 1, illustrating its operation just after a heating cycle has been changed to a cooling cycle.

Referring to FIG. 4, a switchover operation of the heating cycle to the cooling cycle is explained.

An electric current to the pilot electromagnetic valve means 23 is cut off and the plunger 23*a* moves to the right by the action of the coil spring 23*c* thereby to press the ball 20 over the force of high pressure gas which is about to enter the room R. In this instance, the port $17a_1$ is closed and the port $18a_1$ is opened, and pressure of the gas in the room $R_1$ is lowered because the gas flows in the direction shown by an arrow in the drawing. Accordingly, the valve rod 13 with the selector valve 12 is pushed to the right by pressure difference and the flow circuit of refrigerant is to return to the one shown in FIG. 1.

As described, according to the present invention, there is provided a reversing valve means in which a cooling cycle and a heating cycle can be surely converted to each other using only one selector valve actuated by pressure difference in the refrigerant gas.

Even a small force generated at a samll section such as the switchover section may cause a large power which acts upon the reversing valve means, enabling a control of changeover of cycles to be sure.

What is claimed is:

1. A reversing valve means for use with a reversible refrigerating cycle system comprising first and second means functioning alternately and in reverse as a condenser and an evaporator;

a compressor means associated with said first and second means;

a cylindrical reversing valve body associated with said first and second means and with said compressor means, said reversing valve body having first and second ports communicating with pipes of said first and second means respectively, a third port located between said first and second ports and communicating with a suction pipe of the compressor and a fourth port communicating with a discharge pipe of the compressor, said first, second and third ports being provided at one side of said reversing valve body in alignment with one another axially of said reversing valve body;

a valve seat having three holes each corresponding to said first, second and third ports, respectively;

a selector valve connected with a valve rod, said valve rod having a first larger pressure-sensing portion and a second smaller pressure-sensing portion, said selector valve and valve rod being movable within said reversing valve body in the axial direction thereof by means of differing pressures on said first and second pressure-sensing portions, said selector valve having a concave thereunder adapted to connect said third port selectively with said second port and said first port and being slidable on said valve seat;

a switchover section associated with said reversing valve body and having a common passage, a first passage in communication with said compressor discharge pipe for introducing high-pressure refrigerant to said switchover section, a second passage in communication with said compressor suction pipe for introducing low-pressure refrigerant to said switchover section; and a pilot electromagnetic valve means adapted to connect said common passage selectively with said first passage and said second passage, said movable valve rod dividing the valve body into fixedly located first and second rooms each having an end closed by said larger pressure-sensing portion and smaller pressure-sensing portion, respectively, said fourth port opening into said second room, said larger pressure-sensing portion of said valve rod being in communication with said common passage of said switchover section.

2. The apparatus of claim 1, including an annular space formed radially between the intermediate part of the valve rod and the peripheral wall of said first room, the length of said annular space varying with axial movement of the valve rod, passage means continuously connecting said annular space to said compressor suction pipe.

3. The apparatus of claim 1, in which said first and second rooms are respectively of larger and smaller diameter, said valve rod comprising a piston free of refrigerant passages therethrough, said larger and smaller pressure-sensing portions being axially opposite end faces of said piston and corresponding in diameter to said first and second room diameters respectively, first and second seals at the ends of the piston and respectively engaging the peripheral walls of said first and second rooms.

4. The apparatus of claim 3, in which said pilot valve means includes a valve chamber communicating at opposite ends with said first and second passages and intermediate its end with said common passage, a freely movable valve member in said chamber, a plunger engageable with said valve member and electromagnetic means actuable for causing said plunger to block said second passage with said valve member and therewith open low pressure communication between said first and common passages, spring means responsive to deactuation of said electromagnetic means for shifting said plunger away from said valve member, said valve member being then solely responsive to a pressure drop thereacross from said second passage to said first passage for blocking the latter and connecting said common and second passages.

5. The apparatus of claim 3, in which said three-hole valve seat is disposed in said second room, said second room extending to the respective end of said reversing valve body and being continuously open axially past said selector valve, said valve body being continuously and completely supplied with high pressure compressor discharge refrigerant by said fourth port axially from said piston to said respective valve body end.

6. The apparatus of claim 2, in which said compressor discharge pipe connects directly to said second passage and second room and in operation continuously supplies both with high pressure refrigerant, said compressor suction pipe connecting directly with said third port, an open conduit to said annular space of which said passage means consists, and said first passage.

7. A reversing valve means for use with a reversible refrigerating cycle system comprising first and second means functioning alternately and in reverse as a condenser and an evaporator;

a compressor means;

an elongate reversing valve body axially divided into only two rooms, the first said room being of diameter exceeding that of the second said room;

a valve seat extending axially along one peripheral wall portion of said second room;

first and second ports and an intermediate third port distributed along said valve seat and opening therethrough from outside said reversing valve body into said second room, said first, second and third ports respectively fixedly communicating externally with said first means, second means and the low pressure refrigerant suction side of said compressor means;

a selector valve member movable along said valve seat loosely within said second room and having a concavity facing said valve seat and sized to connect said third port alternately with said first and second ports;

a piston axially shiftable in said reversing valve body and continuously blocking communication between said first and second rooms, said piston having first and second ends respectively facing into said first and second rooms, sealingly engaging the inner peripheral walls thereof, and conforming to the diameters thereof, wherein the diameter of said first piston end exceeds the diameter of the second piston end, said selector valve member being fixed to said piston for axial movement thereby into said alternative communication with said first and second ports;

a fourth port fixedly communicating externally with the high pressure refrigerant discharge side of said compressor means and opening into said second room out of the path of said piston and selector valve member, wherein high pressure refrigerant from said compressor discharge continuously and fully occupies the second of said two rooms;

a switchover section associated with said reversing valve body and having a common passage open to said first room, a first passage open to said compressor discharge for passing high pressure refrigerant, and a second passage open to said compressor section side for passing low pressure refrigerant, pilot valve means connecting said common passage alternatively to said first and second passages for connecting said selector valve member concavity with said first and second ports, respectively;

an annular space variable in axial length with piston movement and radially defined by the opposed peripheral walls of the intermediate portion of said piston and said first room, and means fixedly venting said space to the compressor suction side to permit said axial piston movement.

* * * * *